US005772460A

United States Patent [19]

Baumann

[11] Patent Number: 5,772,460

[45] Date of Patent: Jun. 30, 1998

[54] ELECTRICAL CONNECTOR

[75] Inventor: Anja Baumann, Heilbronn, Germany

[73] Assignee: Amphenol-Tuchel Electronics GmbH, Germany

[21] Appl. No.: 713,359

[22] Filed: Sep. 13, 1996

[30] Foreign Application Priority Data

Sep. 15, 1995 [DE] Germany ..... 195 34 205.4

[51] Int. Cl.[6] ..... H01R 13/627

[52] U.S. Cl. ..... 439/352

[58] Field of Search ..... 439/357, 358, 439/352, 353, 731, 686, 687, 695, 696

[56] References Cited

U.S. PATENT DOCUMENTS 5,586,903 12/1996 Hoffmann ..... 439/352

5,591,041 1/1997 Cecil, Jr. et al. ..... 439/352

FOREIGN PATENT DOCUMENTS

| | | | |
|---|---|---|---|
| 0 591 947 A2 | 4/1994 | European Pat. Off. | H01R 13/639 |
| 0 591 948 A2 | 4/1994 | European Pat. Off. | H01R 13/639 |
| 43 17 344 A1 | 12/1994 | Germany | H01R 13/62 |
| 44 30 358 A1 | 4/1995 | Germany | B60R 21/16 |

*Primary Examiner*—Gary F. Paumen
*Assistant Examiner*—Yong Ki Kim
*Attorney, Agent, or Firm*—Bacon & Thomas

[57] ABSTRACT

The invention relates to an electrical connector, particularly for use between a generator (a receptacle) and an electrical control unit, for inflatable restraint systems in motor vehicles.

8 Claims, 1 Drawing Sheet

ELECTRICAL CONNECTOR

BACKGROUND OF THE INVENTION

1. Field of the Invention

The application relates to an electrical connector, particularly for use between a generator (an receptacle) and an electrical control unit for inflatable restraint systems in motor vehicles.

2. Description of Related Art

Such a connector is known from the EP 0 591 948 A2. A connector of the generic type has a very limited size (for example, length: 2 to 3 cm, width: approx. 1 cm, height: 0,1 to 1,0 cm). Therefore, the catch pins hinged to the lower part of the shell for attaching the shell to the receptacle have a length of only a few millimeters with the effect that their "elastic force" is very limited. This results in difficulties in the fabrication of the connector with an associated receptacle. The locking force is relatively high, whereby an assembly by hand as well as by machine becomes more difficult.

From the EP 0 591 948 A2, it is also known to secure the catch pins by a locking member against accidental detachment. The locking member is a separate component and has to be provided accordingly by the user in the fabrication of the connector and to be installed later.

Connectors for the field of application mentioned at the beginning are also described in the EP 0 591 947 A2 and DE 44 30 358 A1.

SUMMARY OF THE INVENTION

It is an object of the invention to improve a generic connector to minimize the insertion force necessary in the fabrication with the associated receptacle and accordingly the force for a possible detachment. Moreover, the handling of the connector, especially in its fabrication (assembling) is intended to be improved altogether.

According to the invention, this is achieved in an connector with the features mentioned in the preamble of claim 1 in that the catch pins extend from the upper part of the shell, and the lower part of the shell has openings through which, in the closed condition of the shell, the catch pins pass.

Contrary to the state of the art, the catch pins are hinged not to the lower part of the shell but to the upper part of the shell. The advantage of this is that they become longer and therefore the "elastic force" increases, the insertion as well as the detachment being facilitated thereby.

According to the invention, the length of the catch pins may be increased by the distance between the lower part of the shell and the upper part of the shell. This is a substantial advantage, especially with respect to the small structure of the connectors of this type.

The catch pins are for example formed with projecting detents at the end which, in plugging the connector onto an associated receptacle, catch resiliently behind corresponding bead-like recesses on the receptacle.

To secure the catch pins against accidental detachment, locking members are known (EP 0 591 948 A2). There, corresponding projections of the locking member reach behind the associated catch pins.

The connector according to the invention is improved in an embodiment in such a way that the locking member consists of an U-shaped part, the U-legs thereof being formed, for securing the catch pins against accidental detachment in the mounting position, to be guidable through openings in the shell bottom and top behind the catch pins (on the side opposite to the corresponding detents) which secure catch pins free from play and are themselves lockable with respect to the shell and/or the receptacle by resilient catch means. Hereby, an increased locking effect is achieved.

Another embodiment of the connector is characterized in that the (insertion) openings in the upper and lower parts of the shell are formed so that, in a pre-assembled condition not corresponding to the locking position, the locking member lies, inclined at an angle alpha to the locking position, in the shell and the locking member is held releasably at the shell by corresponding holding means at the locking member and the shell.

This facilitates to provide the connector (including the locking member) in the pre-assembled condition to a customer, for example, who finishes the assembly.

By this pre-fabrication, the separate provision of a locking member is omitted. Now, it is already releasably fixed to the shell in a pre-assembled position.

The securing of the locking member to the shell (in the pre-assembled condition) may be carried out in different ways.

An embodiment provides for the formation of an undercut on the exterior of the upper part of the shell, into which a locking hook disposed at the locking member can be engaged.

Thus, the locking member is guided first perpendicularly to the upper part of the shell into said openings, for example, but is then, before reaching the locking position, inclined and releasably secured to the undercut of the upper part of the shell with the aid of the locking hook.

Another embodiment provides that the U-legs of the locking member have nub-like projections which are securable in corresponding beads on the shell. Of course, both the nub-like projections and the beads on the shell are disposed to prelock the locking member in a position outside the final locking position.

The mentioned embodiment may also be effected inversely. Then the U-legs of the locking member are formed with openings, by means of which the locking member can be put onto corresponding nubs or pins on the shell. In this pre-assembled position, the locking member usually will project beyond the upper part of the shell. Especially in the "inclined position" it is easily recognizable for the mechanic that the locking member has not reached its end position yet. But even when the locking member projects beyond the upper part of the shell, it can easily be realized that the securing of the catch pins still has to be carried out.

While the upper and lower parts of the shell (inclusive of the catch pins) are typically made of synthetic material, the locking member may be a metal part and for example be made of a spring steel sheet. The advantage is that the metal parts, especially spring steel sheets, can be designed with a very small thickness of material. This is of advantage, especially with connectors of a very small structure, as they are here, because only little space is available. Nevertheless, the said metal parts meet the requirements made to them with regard to stability and safety.

In a metal design, the catch means of the locking member may be formed in situ and for example be made of spring tongues which are punched out of the U-legs of the locking member and are bent off.

Other features of the invention follow from the characterizing parts of the subclaims as well as the other application documents.

In the following, the invention will be explained in more detail by means of an embodiment.

BRIEF DESCRIPTION OF THE FIGURE OF DRAWING

FIG. 1 shows a vertical section through a connector according to the invention, FIG. 2 shows a section taken along line 2—2 in FIG. 1, FIG. 3*a–c* show a plan view, a side view and a front view of a locking member.

DETAILED DESCRIPTION OF THE INVENTION

Figure 1:
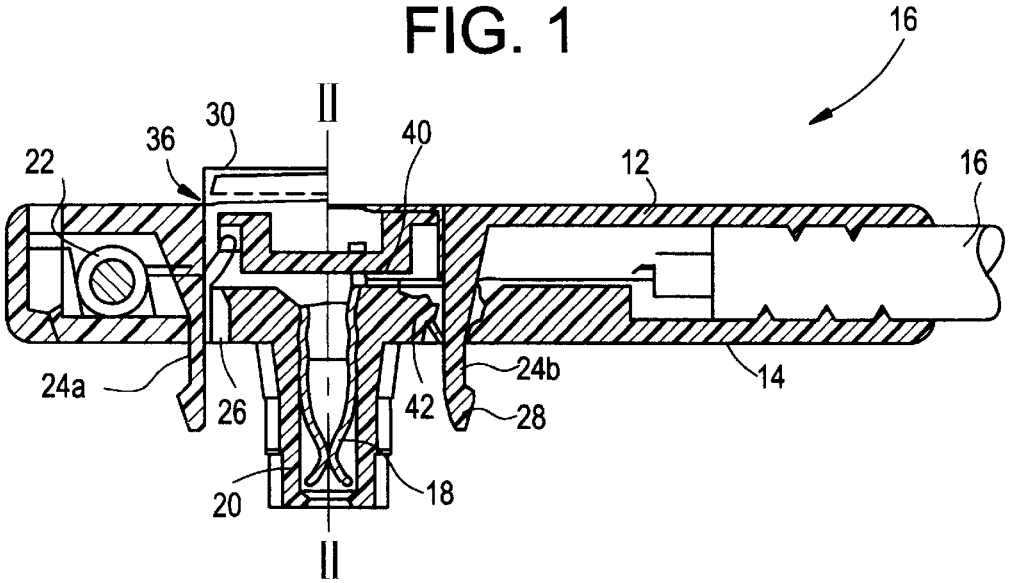

The principle structure of a connector, as illustrated in FIG. 1, is known in the art. The shell 10 consists of an upper part 12 of the shell and a lower part 14 of the shell. Cables 16 are running between the shell parts 12, 14 to contact springs 18 which run within a trunk-like extension 20 of the lower part 14 of the shell. Further, a RF choke 22 can be seen, the connection ends of which are connected to the contact springs 18.

As shown in FIG. 1, catch pins 24*a, b* extend from the inside of the upper part 12, which are guided through corresponding openings 26 in the lower part 14 of the shell in putting together the shell parts 12, 14 and are projecting beyond the openings 26 with their ends, each enlarged towards the outside like a detent 28.

In order to guide the (enlarged) detents 28 through the openings 26, these are formed with an appropriate cross section so that, in the fabricated position of the shell (FIG. 1), the catch pins 24*a, b* are guided in the openings 26 with play.

Because of the particular length of the catch pins 24*a, b* these have an increased flexibility so that they can easily be guided towards each other in the plugging onto an associated receptacle (not illustrated herein) and then spring back behind corresponding recesses in the receptacle.

The free cross section caused thereby in the zone of the openings 26 is then "closed" by means of a locking clip 30 to prevent a backspringing of the catch pins 24*a, b* and with it a loosening of the connector from the receptacle.

Figure 2:
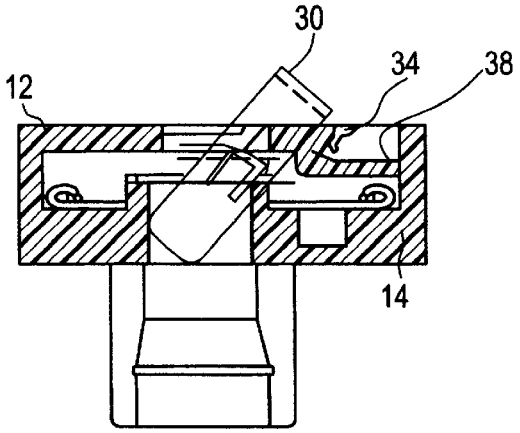
Figure 3A:
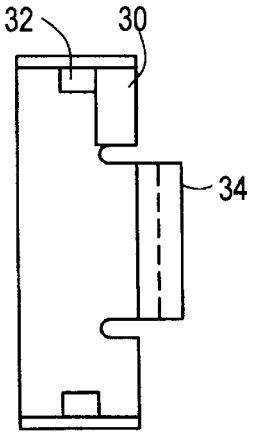
Figure 3B:
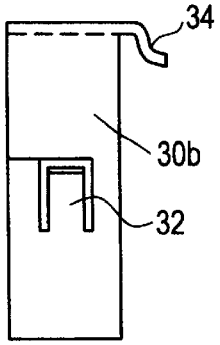

Details of the locking clip 30 and its different mounting positions follow from FIGS. 2 and 3.

Figure 3C:
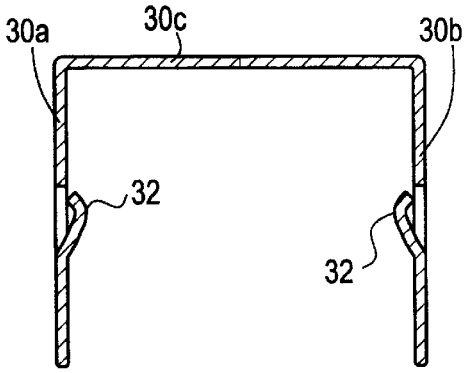

The basic shape of the locking clip 30 with an U-shaped cross section can be seen in FIG. 3*c*. Tongues 32 are punched out of the U-legs 30*a, b* and are offset to the inside (towards each other).

A clamping strap 34 having several offset portions at its free end extends from the base leg 30*c* approximately in the center.

In the left part of FIG. 1 and in FIG. 2, the locking member 30 can be seen in a pre-assembled condition.

For that the U-legs 30*a, b* are guided first into shell openings 36 and the locking clip 30 is then inclined to the side-as illustrated in FIG. 2, until, with its clamping strap 34, it reaches an undercut in the upper part 12 of the shell and has been engagingly locked there.

This pre-assembly may be carried out independently of the equipment of the connector, and thus also long before connecting the connector to an associated receptacle. The substantial advantage is that the locking clip 30 need not be kept as separate component but, upon the final assembly, is inserted into the shell, already prepositioned.

Now, after the final fitting and the locking of the connector with a receptacle, the locking clip may be turned back and pushed further in the direction to the receptacle until it has reached the right-hand position in FIG. 1, so it supports the associated locking pins 24*a, b* with its lower free end.

In the illustrated embodiment, this is effected "resiliently", that is due to the tongues 32 illustrated in the FIGS. 3*a, b*, which, in the insertion of the locking clip 30, are pushed back first at an edge 40 of the lower part 14 of the shell before they spring back behind a recess 42, due to their spring action, and increase the elastic force onto the locking pins 24*a, b*.

The locking clip 30 consists of a spring steel sheet and is formed here—as shown in the Figure—with very much smaller thickness than the associated locking pins 24*a, b*, the configuration of the connector can be made smaller even further and be optimized thereby.

I claim:

1. An electrical connector, particularly for use between a receptacle and an electrical control unit for inflatable restraint systems in motor vehicles, comprising:

a shell consisting of a lower part of the shell and an upper part of the shell for receiving electrical cables as well as contact springs connectable to them for receiving contact pins of the associated receptacle with squib, resilient catch pins on the shell for securing the shell to the receptacle, wherein the catch pins extend from the upper part of the shell, and the lower part of the shell has openings through which the catch pins pass in the closed condition of the shell, and a U-shaped locking member having legs which are guidable through openings behind the catch pins to secure the catch pins against accidental detachment in the mounting position.

2. Connector according to claim 1, wherein the openings in upper and lower parts of the shell are formed so that, in a pre-assembled condition not corresponding to the locking position, the locking member lies in the shell, inclined at an angle alpha to the locking position, and the locking member is held detachably on the shell via corresponding holding means at the locking member and the shell, respectively.

3. Connector according to claim 2, wherein the upper part of the shell is formed with an undercut on the outside, into which a locking hook disposed on the locking member can be engaged.

4. Connector according to claim 2, wherein the U-legs of the locking member have nub-like projections, which are securable in corresponding beads on the shell.

5. Connector according to claim 2, wherein the U-legs of the locking member have openings, by means of which the locking member can be put onto corresponding nubs or pins on the shell.

6. Connector according to claim 1, wherein the locking member is a metal part.

7. Connector according to claim 6, wherein the locking member is made of a spring steel sheet.

8. Connector according to claim 1, wherein the catch means of the locking member consist of spring tongues which are punched out of the U-Legs of the locking member and are bent off.

* * * * *